US008979679B2

(12) United States Patent
Lee

(10) Patent No.: US 8,979,679 B2
(45) Date of Patent: Mar. 17, 2015

(54) GOLF BALL HAVING HYDROPHILIC AND HYDROPHOBIC PORTIONS

(75) Inventor: David S. Lee, Wenham, MA (US)

(73) Assignee: NIKE, Inc., Beaverton, OR (US)

( * ) Notice: Subject to any disclaimer, the term of this patent is extended or adjusted under 35 U.S.C. 154(b) by 497 days.

(21) Appl. No.: 13/338,129

(22) Filed: Dec. 27, 2011

(65) Prior Publication Data

US 2013/0165271 A1 Jun. 27, 2013

(51) Int. Cl.
*A63B 37/06* (2006.01)

(52) U.S. Cl.
USPC ..... 473/378

(58) Field of Classification Search
USPC ..... 473/378
See application file for complete search history.

(56) References Cited

U.S. PATENT DOCUMENTS

| | | | | |
|---|---|---|---|---|
| 3,965,955 | A | 6/1976 | Price | |
| 4,768,787 | A | 9/1988 | Shira | |
| 4,964,641 | A | 10/1990 | Miesch et al. | |
| 5,266,669 | A | 11/1993 | Onwunaka et al. | |
| 5,334,691 | A | 8/1994 | Gould et al. | |
| 5,358,249 | A | 10/1994 | Mendralla | |
| 5,647,808 | A | 7/1997 | Hosokawa | |
| 5,885,171 | A | 3/1999 | Sharpe | |
| 6,270,424 | B1 | 8/2001 | Holub | |
| 6,372,323 | B1 | 4/2002 | Kobe et al. | |
| 6,811,497 | B1 * | 11/2004 | Jones et al. | 473/376 |
| 7,368,163 | B2 | 5/2008 | Huang et al. | |
| 7,387,765 | B2 | 6/2008 | Chen et al. | |
| 7,427,243 | B2 | 9/2008 | Sullivan | |
| 7,442,556 | B2 | 10/2008 | Manger et al. | |
| 7,749,099 | B2 | 7/2010 | Ban et al. | |
| 7,922,601 | B2 | 4/2011 | Ban et al. | |
| 7,976,404 | B2 | 7/2011 | Golden et al. | |
| 2002/0160863 | A1 | 10/2002 | Wu et al. | |
| 2003/0186035 | A1 | 10/2003 | Cruce et al. | |
| 2004/0224792 | A1 * | 11/2004 | Brown | 473/378 |
| 2005/0209020 | A1 | 9/2005 | Burrows | |
| 2007/0178988 | A1 | 8/2007 | Tavares et al. | |
| 2007/0213143 | A1 | 9/2007 | Chinn et al. | |
| 2009/0197700 | A1 | 8/2009 | Ban et al. | |

(Continued)

FOREIGN PATENT DOCUMENTS

| | | |
|---|---|---|
| DE | 20001933 | 4/2001 |
| EP | 0743080 | 11/1996 |

(Continued)

OTHER PUBLICATIONS

Notification of Transmittal of the International Search Report and the Written Opinion of the International Searching Authority in connection with International Patent Application No. PCT/US2012/070973 mailed on May 30, 2013; 15 pages.

(Continued)

*Primary Examiner* — Raeann Gorden
(74) *Attorney, Agent, or Firm* — Honigman Miller Schwartz and Cohn LLP; Matthew H. Szalach

(57) ABSTRACT

A golf having hydrophilic and hydrophobic portions is disclosed. In wet playing conditions, moisture may be repelled by the hydrophobic portions and attracted to the hydrophilic portions. Thus, the surface of the hydrophobic portions may remain dry such that the friction between a golf club head and the golf ball surface is not reduced. As a result, the golf ball may not be adversely affected by wet playing conditions.

10 Claims, 14 Drawing Sheets

(56) References Cited

U.S. PATENT DOCUMENTS

| | | | |
|---|---|---|---|
| 2009/0318243 | A1 | 12/2009 | Golden et al. |
| 2010/0035703 | A1 | 2/2010 | Ishikawa et al. |
| 2010/0056295 | A1 | 3/2010 | Ban et al. |
| 2010/0087270 | A1 | 4/2010 | Ban et al. |
| 2010/0175797 | A1 | 7/2010 | Dowling |
| 2010/0261538 | A1 | 10/2010 | Lee |
| 2011/0224024 | A1 | 9/2011 | Tutmark |
| 2011/0319197 | A1 | 12/2011 | Fitchett |

FOREIGN PATENT DOCUMENTS

| | | | |
|---|---|---|---|
| EP | 0960635 | | 12/1999 |
| EP | 1224983 | A2 | 7/2002 |
| JP | 2021882 | | 1/1990 |
| JP | 6114129 | | 4/1994 |
| JP | 10314346 | | 12/1998 |
| JP | 2009153921 | | 7/2009 |

OTHER PUBLICATIONS

Simpson, John and D'Urso, Brian R. (researchers, Engineering Science & Technology Division), Presentation at IAC Meeting by John T. Simpson, PhD., Feb. 1, 2007, "Superhydrophobic and Nano-structured Materials, A Different Type of Nanotechnology" (Oak Ridge National Laboratory, U.S. Department of Energy) 33 pages.

Annex to Form PCTIISAI206 Communication Relating to the Results of the Partial International Search mailed Aug. 5, 2010 for PCTIUS2010/029788.

* cited by examiner

GOLF BALL HAVING HYDROPHILIC AND HYDROPHOBIC PORTIONS

BACKGROUND

The present invention relates generally to a golf ball having hydrophilic and hydrophobic portions.

The game of golf is an increasingly popular sport at both amateur and professional levels. A wide range of technologies related to the manufacture and design of golf balls are known in the art. Such technologies have resulted in golf balls with a variety of play characteristics. Modern golf balls generally comprise either a one-piece construction or several layers including an outer cover surrounding a core. The outer cover of golf balls often becomes slick in moist playing conditions. As a result, the golf club face may slip as it contacts the golf ball. This slippage causes the golf ball to experience a lower trajectory flight path, and also decreases spin on the ball. This decreased spin reduces the amount of control the golfer has over the golf ball's flight path and landing conditions. It would be advantageous to be able to make a golf ball that does not become slick in wet playing conditions.

SUMMARY

In one aspect the disclosure provides a golf ball that may have a core and a cover layer substantially surrounding the core. The cover layer may include at least one dimple. The at least one land area may be adjacent to the at least one dimple. A portion of the surface of the golf ball may be hydrophobic and a portion of the surface of the golf ball may be hydrophilic. The hydrophilic portion of the surface may be adjacent the hydrophobic portion of the surface such that moisture is drawn away from the hydrophobic portion and drawn toward the hydrophilic portion. The hydrophilic portion of the surface may include multiple portions of the surface. The hydrophilic portions of the surface may be surrounded by the hydrophobic portion of the surface such that moisture is drawn away from the hydrophobic portion and drawn toward the hydrophilic portions. The at least one dimple may include multiple dimples and the hydrophilic portions may coincide with the dimples. The hydrophilic portion may coincide with the at least one dimple.

In one aspect the disclosure provides a golf ball that may have a core and a cover layer substantially surrounding the core. The cover layer may include at least one dimple. The at least one land area may be adjacent to the at least one dimple. The surface of the at least one land area may be hydrophobic and the surface of the at least one dimple may be hydrophilic. A hydrophilic coating material may overlie the at least one dimple. The hydrophilic coating material may include a hydrophilic polymer. The hydrophilic coating material may have a uniform thickness. The hydrophilic coating material may have a maximum thickness in the middle of the at least one dimple. The thickness of the hydrophilic coating material may taper toward an edge of the at least one dimple and the edge may be adjacent the at least one land area. The hydrophilic coating material may overlie the entire surface of the at least one dimple. The hydrophilic coating material may overlie only a portion of the surface of the at least one dimple. The at least one dimple may comprise multiple dimples and a hydrophilic coating material may overlie at least one of the multiple dimples. The hydrophilic coating material may overlie all of the multiple dimples. The surface of the cover layer may be superhydrophobic.

In one aspect the disclosure provides a golf ball that may have a core and a cover layer substantially surrounding the core. The cover layer may include multiple dimples and at least one land area adjacent to the dimples. The surface of the at least one land area may be hydrophobic and the surface of at least one of the multiple dimples may be hydrophilic. Coating material may overlie the at least one of the multiple dimples that may be hydrophilic. The surface of at least one of the multiple dimples may be hydrophobic.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
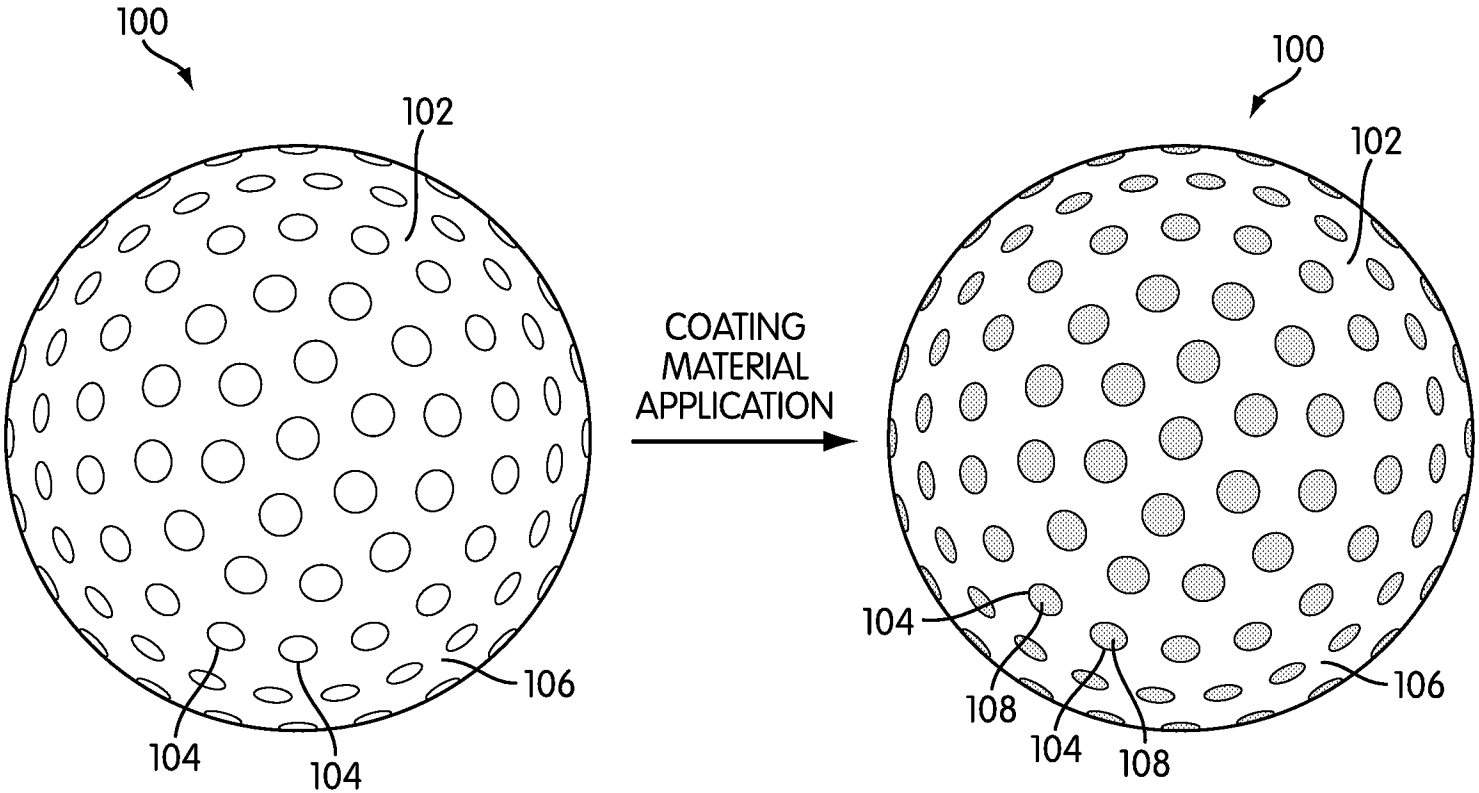
FIG. 1 is an exemplary golf ball before and after a coating material has been applied.

Golf balls typically include a core substantially surrounded by one or more layers. For example, a golf ball may be of a two-piece construction, having only a core and a cover layer, or a golf ball may have one or more intermediate layers located between the core and the cover layer. Golf balls within the scope of this disclosure may be of a two-piece construction, or may have additional intermediate layers between the core and cover layer. Referring to FIG. 1, a golf ball 100 may include a cover layer 102. Cover layer 102 may include dimples 104 and a land area 106. Dimples 104 may generally be arranged on cover layer 102 in any pattern, as may be known in the art of golf balls. Various known dimple packing patterns are known in the art. Dimples 104 may generally be of any shape, such as circular, triangular, or multi-sided. Dimples 104 may be of uniform shape and size, or the dimple pattern may be made up of two or more different types of dimples having (for example) different sizes or different shapes. Land area 106 may be part of cover layer 102 that separates at least two dimples 104 and that is not indented or otherwise part of the dimple. Generally, land area 106 may be the "ridge" or "fret" between adjoining dimples 104.

In the embodiment shown in FIG. 1, a coating material 108 may be selectively applied on dimples 304. In such an embodiment, coating material 108 may have a higher level of hydrophilicity than the level of hydrophilicity of the material of cover layer 102. Accordingly, after coating material 108 is applied to dimples 104, dimples 104 may have a higher level of hydrophilicity than the level of hydrophilicity of land area 106. Hydrophilic means attracting water and hydrophobic means repelling water. If dimples 104 are hydrophilic and land area 106 between dimples 104 is hydrophobic, then water may be drawn away from land area 106 toward the dimples 104. As a result, moisture may be less likely to collect on the surface of land area 106 and the surface of the land area 106 may be dryer than the land area on a conventional golf ball would be. The cover layers of conventional golf balls often become slick in moist or wet playing conditions. This moisture is a problem because it makes the club face slip as it contacts the golf ball. Also, the moisture present on the conventional golf ball may affect the aerodynamics of the golf ball and cause the golf ball to not travel as far as the golf ball would travel in dry playing conditions. Thus, preventing moisture from settling on land area 106 may prevent these problems associated with the presence of moisture on land area 106.

The hydrophobicity of a given substrate surface may be measured using a water droplet shape analysis method, for example. The higher the contact angle, the higher the hydrophobicity. A surface that makes a contact angle with water ("θ") of less than 90° is considered hydrophilic. A surface that makes a contact angle with water ("θ") of more than 90° is considered hydrophobic. A surface that makes a contact angle with water ("θ") of more than about 150° is considered superhydrophobic. The term "hydrophobic," as used herein, is inclusive of surfaces that are considered superhydrophobic. The relative hydrophilicity of two surfaces can be determining by comparing the contact angles between the surfaces and water. For example, a surface that makes a contact angle with water of 60° is less hydrophilic than a surface that makes a contact angle with water of 30°.

In some embodiments, cover layer 102 may be made from any known hydrophobic material. In some embodiments, cover layer 102 may be treated to become hydrophobic by any known methods. Suitable hydrophobic materials and methods of achieving hydrophobic surfaces are disclosed in, for example, commonly owned U.S. Patent Publication Number 2010/0261538, entitled Golf Club Having Hydrophobic and Hydrophilic Portions, published on Oct. 14, 2010, and applied for by Lee, the disclosure of which is hereby incorporated by reference in its entirety. Suitable hydrophobic materials and methods of achieving hydrophobic surfaces are also disclosed in, for example, U.S. Patent Publication Number 2007/0213143, entitled Exterior Coatings for Golf Balls, published on Sep. 13, 2007, and applied for by Chinn et al., the disclosure of which is hereby incorporated by reference in its entirety. The cover material used for cover layer 102 and/or methods of achieving a hydrophobic surface may be selected based on a variety of factors. For example, the cover material may be selected based on the desired hydrophobicity of land area 106, desired aerodynamic properties, hardness of cover layer 102, and/or the type of coating material 108 used.

In some embodiments, coating material 108 may be made from any know hydrophilic material. In some embodiments, coating material 108 may treated to become hydrophilic by any known methods. Suitable hydrophilic materials and methods of achieving hydrophilic surfaces are disclosed in, for example, commonly owned U.S. Patent Publication Number 2010/0261538, entitled Golf Club Having Hydrophobic and Hydrophilic Portions, published on Oct. 14, 2010, and applied for by Lee, the disclosure of which is hereby incorporated by reference in its entirety. Suitable hydrophilic materials and methods of achieving hydrophilic surfaces are also disclosed in, for example, commonly owned U.S. Patent Publication Ser No. 8,393,979, currently U.S. patent application Ser. No. 12/822,470, entitled Golf Ball with Hydrophilic Coating Layer, filed on Jun. 24, 2010, and applied for by Fitchett, the disclosure of which is hereby incorporated in its entirety. Suitable hydrophilic materials and methods of achieving hydrophilic surfaces are also disclosed in, for example, U.S. Patent Publication Number 2007/0213143, entitled Exterior Coatings for Golf Balls, published on Sep. 13, 2007, and applied for by Chinn et al., the disclosure of which is hereby incorporated by reference in its entirety. Coating material 108 and/or a method of achieving a hydrophilic surface may be selected based on a variety of factors. For example, coating material 108 may be selected based on the desired hydrophilicity of coating material 108, desired aerodynamic properties, hardness of coating material 108, and/or the type of cover material used.

Figure 2:
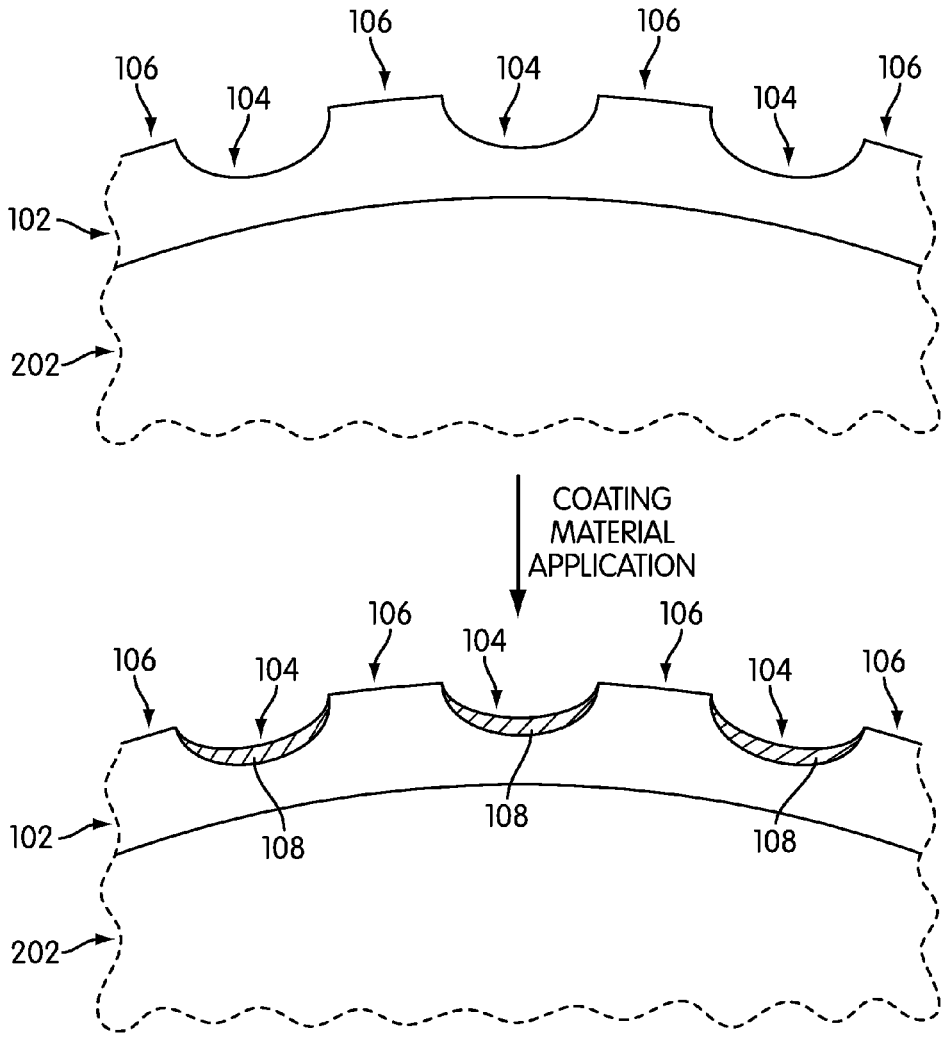
FIG. 2 is a cross section of the golf ball of FIG. 1, before and after a coating material has been applied.
Figure 3:
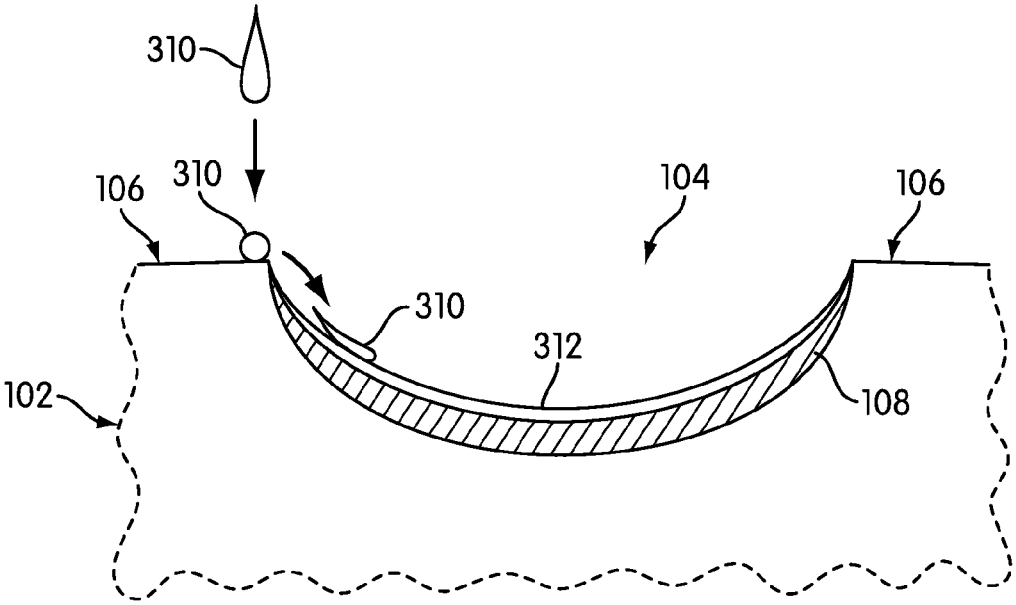
FIG. 3 is a zoomed in view of a water droplet landing on a land area adjacent the dimple of FIGS. 1 and 2 after the dimple a coating material has been applied.
Figure 12:
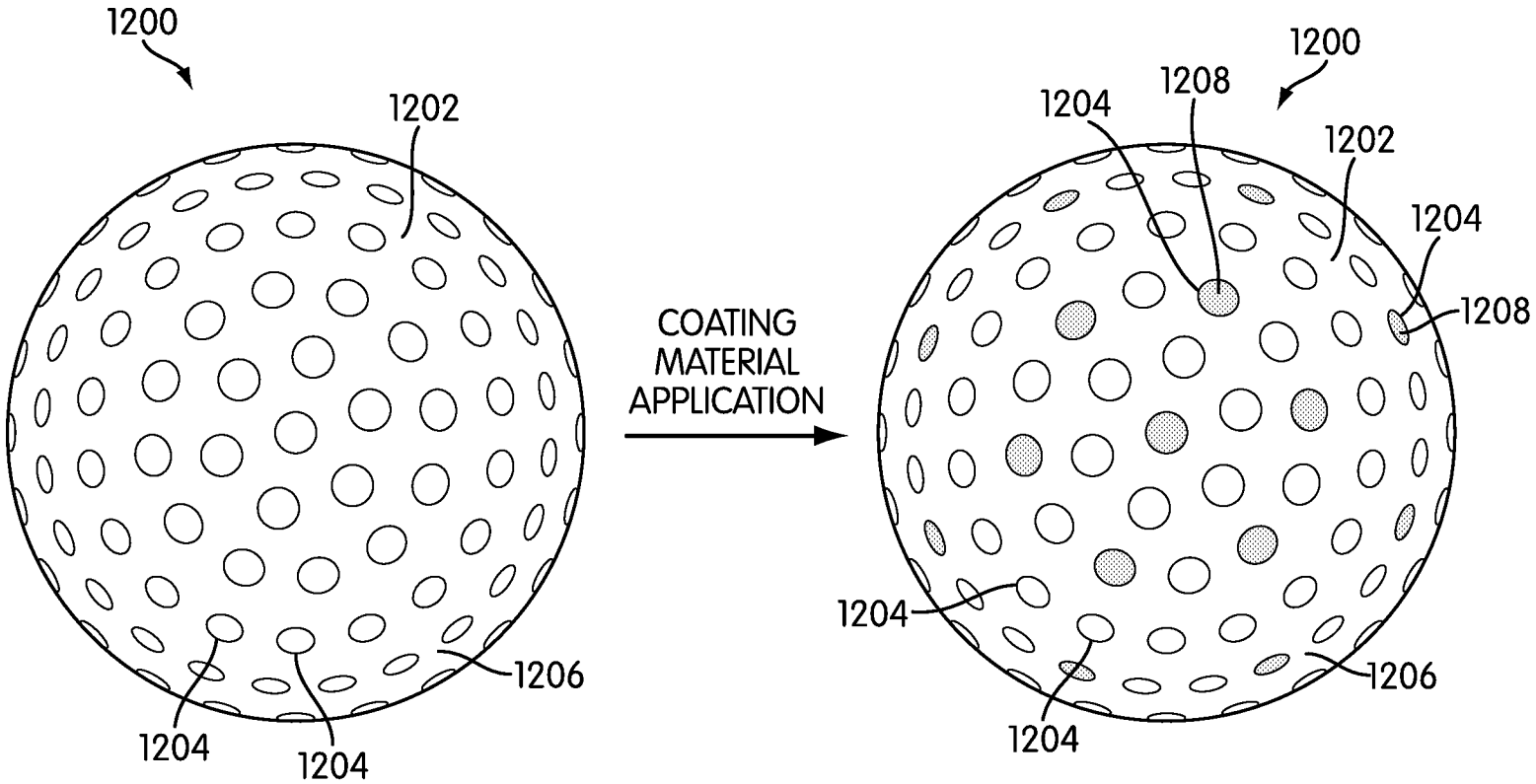

In some embodiments, such as the embodiment shown in FIGS. 1-3, all of dimples 104 may be hydrophilic. In some embodiments, dimples 104 may be selectively hydrophilic. For example, FIG. 12 shows an embodiment of a golf ball 1200 having a cover layer 1202 with dimples 1204 and a land area 1206. A portion of dimples 1204 may be selected to have a layer of coating material 1208. The number and location of dimples 104 selected to be hydrophilic may be selected based on a variety of factors. For example, the number and location of dimples 104 selected to be hydrophilic may be selected based on the total number of dimples 104, the materials used, the weather conditions golf ball 100 is intended to be used in, the shape of dimples 104, and/or the size of dimples 104.

Figure 13:
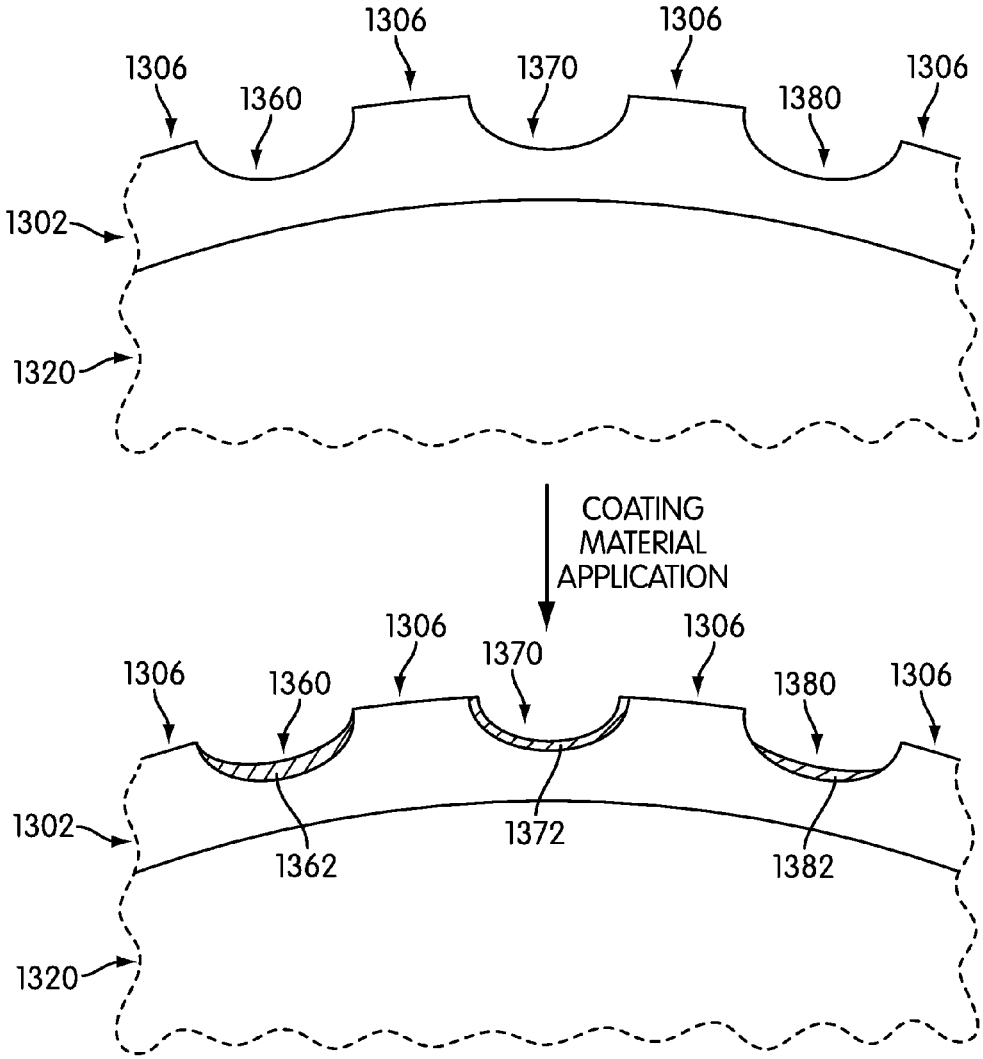

In some embodiments, coating material 108 may have a variety of profiles and/or patterns. FIGS. 2, 3, and 5-8, which are discussed in detail below, show exemplary profiles. In some embodiments, dimples 104 may include different profiles of coating material 108. For example, in the embodiment shown in FIG. 13, a golf ball may have a core 1320 and a cover layer 1302 having a first dimple 1360, a second dimple 1370, a third dimple 1380, and a land area 1306. Each of the dimples may include a coating material with a different profile. First dimple 1360 may include a first profile of coating material 1362, second dimple 1370 may include a second profile of coating material 1372, and third dimple 1380 may include a third profile of coating material 1382. In some embodiments, the dimples may be selectively coated with a variety of profiles. In some embodiments, the coating material may be applied in a pattern on dimples. For example, the coating material may be applied in a pattern of stripes or dots. The profiles and/or patterns of the coating material may be selected based on a variety of factors. For example, the profile of the coating material may be selected based on the total number of dimples, the materials used, the weather conditions golf ball is intended to be used in, the shape of the dimples, and/or the size of the dimples.

FIG. 2 is a cross-sectional view of dimples 104 and land areas 106 shown in FIG. 1. FIG. 2 also shows core 202, which may be covered by cover layer 102. In FIG. 2, coating material 108 may be coated on dimples 104, forming a thin layer of coating material 108 on a cover layer 102. As shown in FIG. 2, the profile of coating material 108 within dimples 104 may be such that the maximum thickness of coating material 108 is in the center of each dimple 104 and the thickness decreases toward the edge of dimples 104 adjacent land area 106. In some embodiments, coating material 108 may have a maximum thickness within a range of 0.1 mm and 3 mm. For example, in some embodiments, coating material 108 may have a maximum thickness of 0.5 mm. In some embodiments, coating material may have a maximum thickness of 0.3 mm. In some embodiments, coating material may have a maximum thickness of 0.1 mm. In some embodiments, the maximum thickness of coating material 108 may be selected based on a variety of factors. For example, the thickness of coating material 108 may be selected based on the type of material cover layer material used, the type of coating material used, the number of dimples, shape of the dimples, and/or the depth of the dimples.

FIG. 3 illustrates how a water droplet 310 landing on land area 106 may be attracted to coating material 108 in dimples 104. Because cover layer 102, and thus land area 106, includes a hydrophobic material, water droplet 310 may be attracted away from land area 106 toward the more hydrophilic coating material 108 in dimples 104.

Figure 4:
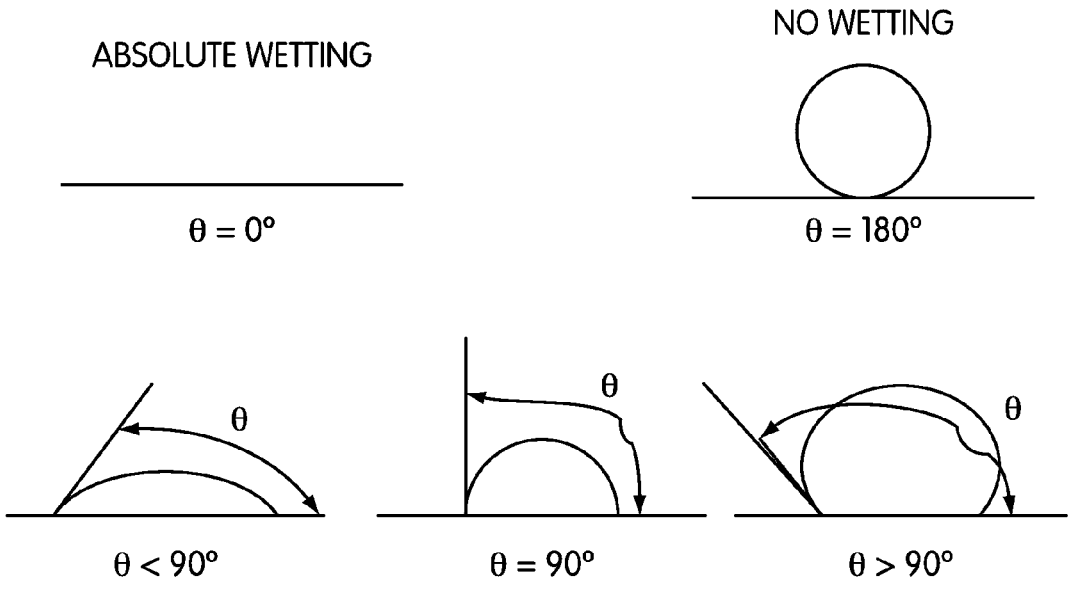
FIG. 4 is an illustration of contact angles between surfaces and water that may be used to quantify whether the surface is hydrophilic or hydrophobic.

With reference to FIG. 4, a surface that makes a contact angle with water ("θ") of less than 90 degrees is considered hydrophilic. A surface that makes a contact angle with water ("θ") of more than about 90 degrees is considered hydrophobic. A surface that makes a contact angle with water ("θ") of more than about 150 degrees is considered superhydrophobic. The term "hydrophobic," as used herein, is inclusive of surfaces that are considered superhydrophobic. The relative hydrophilicity of two surfaces can be determining by comparing the contact angles between the surfaces and water. For example, a surface that makes a contact angle with water of 60 degrees is less hydrophilic than a surface that makes a contact angle with water of 30 degrees. Land area and dimples, as described herein, may be hydrophobic and hydrophilic, respectively. Alternatively, land area and dimples may be weakly hydrophilic and more strongly hydrophilic, respectively. The difference in contact angle with water ("θ") between that of land area and that of the surrounding portion is usually at least about 5 degrees and often ranges from about 10 degrees to about 150 degrees, more usually from about 25 degrees to about 125 degrees or from about 40 degrees to about 100 degrees.

Referring back to FIG. 3, a water droplet 310 may land on land area 106. Because cover layer 102 may include a hydrophobic material, water droplet 310 may contact land area 106 with a contact angle of more than 90 degrees. For example, water droplet 310 may contact land area 106 with a contact angle of 120 degrees. In another example, water droplet 310 may contact land area 106 with a contact angle of 150 degrees. In some embodiments, the contact angle between land area 106 and water droplet 310 may depend on the level of hydrophilicity of the cover material used to make cover layer 102. Water droplet 310 may be repelled from land area 106 while simultaneously being attracted to cover material 108. As shown by the arrows, these forces acting on water droplet 310 may cause water droplet 310 to gravitate toward cover material 108. Because cover material 108 may be hydrophilic, water droplet 310 may flatten onto the surface of cover material 108 such that water droplet 310 makes a contact angle of less than 90 degrees is considered hydrophilic. For example, water droplet 310 may contact cover material 108 at 45 degrees. In another example, water droplet 310 may contact cover material 108 at 0 degrees. The contact angle between coating material 108 and water droplet 310 may depend on the type of coating material used to make cover layer 102.

Because water droplet 310 may flatten out on the surface of cover material 108, water droplet 310 may form a layer 312 of moisture on the surface of cover material 108. In some embodiments, multiple water droplets may combine to form layer 312. In some embodiments, as shown in FIG. 3, the profile of layer 312 may be the same as the profile of coating material 108. For example, the profile of layer 312 may be such that the maximum thickness of layer 312 is in the center of dimple 104 and the thickness decreases toward the edge of dimple 104 adjacent land area 106. In some embodiments, the profile of layer 312 may be uniform so that the thickness is substantially the same in the middle of dimple 104 as the thickness toward the edge of dimple 104 adjacent land area 106. In some embodiments, layer 312 may have the opposite profile of coating material 108. For example, the profile of layer 312 may be such that the maximum thickness of layer 312 is adjacent land area 106 and narrows toward the middle of dimple 104. The thickness of layer 312 may depend on the amount of moisture present on golf ball 100. In some embodiments, layer 312 may change the depth and/or shape of dimple 104, which may affect the aerodynamics of golf ball 100. To counteract this change in depth and/or shape, in some embodiments, dimple 104 may be formed with a deeper depth or different shape than a golf ball used in dry weather. In some embodiments, the depth of the golf ball may be adjustable. A golf ball with changeable dimples is fully described in commonly owned U.S. Patent Publication Ser. No. 8,602,915, currently U.S. patent application Ser. No. 12/916,955, entitled Golf Ball with Changeable Dimples, filed on Nov. 1, 2010, and applied for by Oldknow, the disclosure of which is hereby incorporated in its entirety. In some embodiments, coating material 108 may include a hydrophilic water-swellable material allowing coating 108 to physically change upon exposure to water. In such embodiments, layer 312 may be present or absent. Suitable hydrophilic water-swellable materials are disclosed in, for example, commonly owned U.S. Patent Publication Ser. No. 8,393,979, currently U.S. patent application Ser. No. 12/822,470, entitled Golf Ball with Hydrophilic Coating Layer, filed on Jun. 24, 2010, and applied for by Fitchett, the disclosure of which is hereby incorporated in its entirety.

Figure 5:
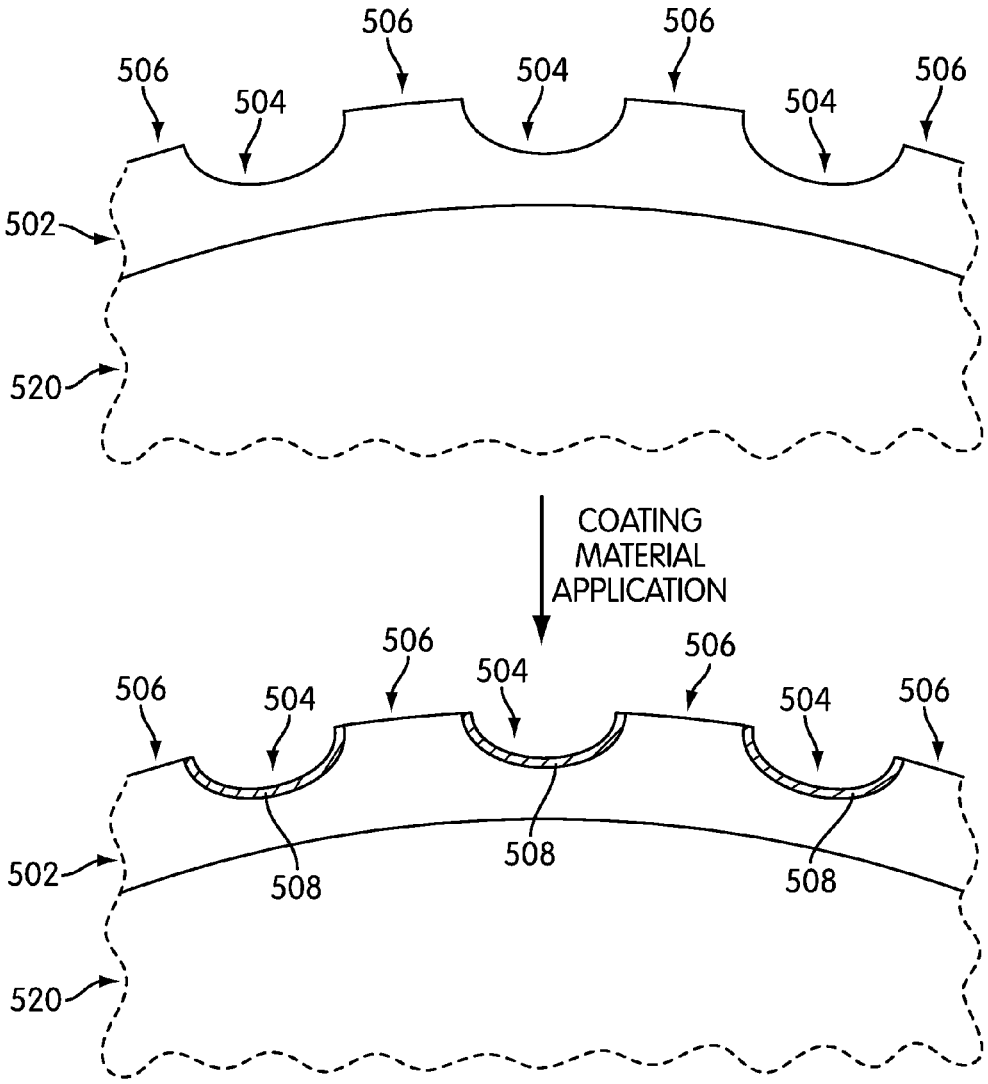
FIG. 5 is a cross section of a golf ball of an exemplary embodiment, before and after a coating material has been applied.
Figure 6:
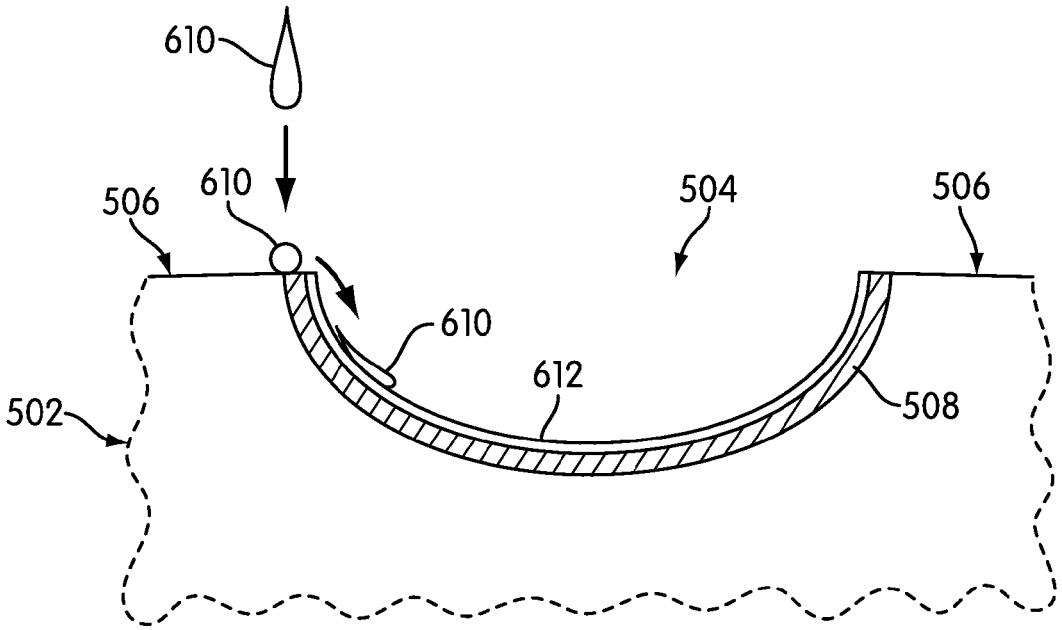
FIG. 6 is a zoomed in view of a water droplet landing on a land area adjacent the dimple of FIG. 5 after the dimple a coating material has been applied.

FIGS. 5 and 6 illustrate an exemplary embodiment similar to the embodiment of FIGS. 1-3. The difference between the two embodiments is the profile of the coating material. Like the embodiment of FIGS. 1-3, the embodiment of FIGS. 5 and 6 may include a golf ball having a core 520 and a cover layer 502. Cover layer 502 may include dimples 504. Coating material 508 may be coated on dimples 504, forming a thin layer of coating material 508 on a cover layer 502. As shown in FIG. 5, the profile of coating material 508 within each dimple 504 may be such that the thickness is substantially consistent throughout the surface of dimple 504. In some embodiments, coating material 508 may have a thickness within a range of 0.1 mm and 3 mm. For example, in some embodiments, coating material 508 may have a thickness of 0.5 mm. In some embodiments, coating material 508 may have a thickness of 0.3 mm. In some embodiments, coating material may have a thickness of 0.1 mm. In some embodiments, the thickness of coating material 508 may be selected based on a variety of factors. For example, the thickness of coating material 508 may be selected based on the type of material cover layer material used, the type of coating material used, the number of dimples, shape of the dimples, and/or the depth of the dimples.

As shown in FIG. 6, a water droplet 610 may behave in substantially the same way water droplet 310 behaves in FIG. 3. As shown in FIG. 6, water droplet 610 may form a layer 612 as water droplet 610 settles in dimple 504. In some embodiments, the profile of layer 612 may be uniform so that the thickness is substantially the same in the middle of dimple 504 as the thickness is toward the edge of dimple 504 adjacent land area 506. As discussed with reference to layer 312, the profile of layer 612 may also vary based on a variety of factors. Similarly, the depth and shape of dimples 504 may be adjusted in the ways described above with reference to FIG. 3 to compensate for the change in depth and shape of dimples 504 caused by water layer 612.

Figure 7:
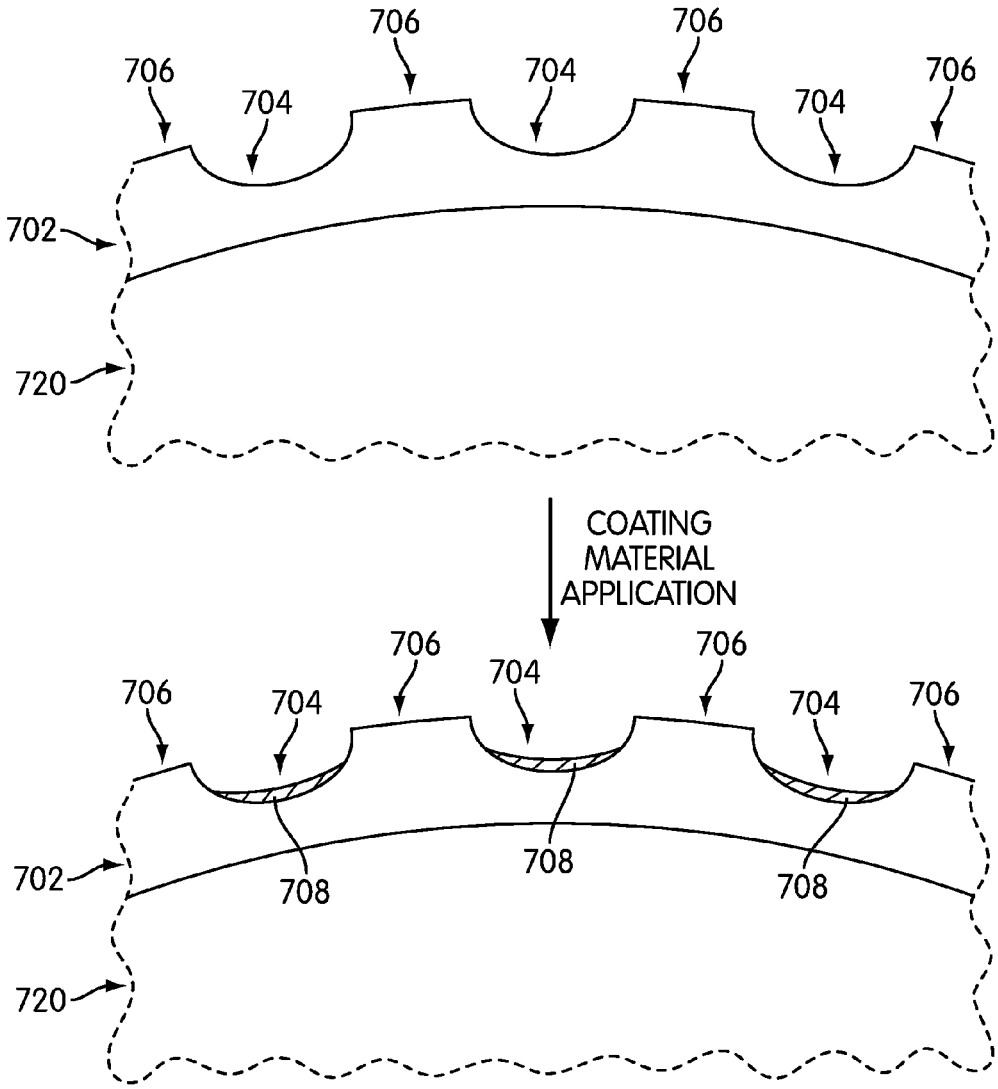
FIG. 7 is a cross section of a golf ball of an exemplary embodiment, before and after a coating material has been applied.
Figure 8:
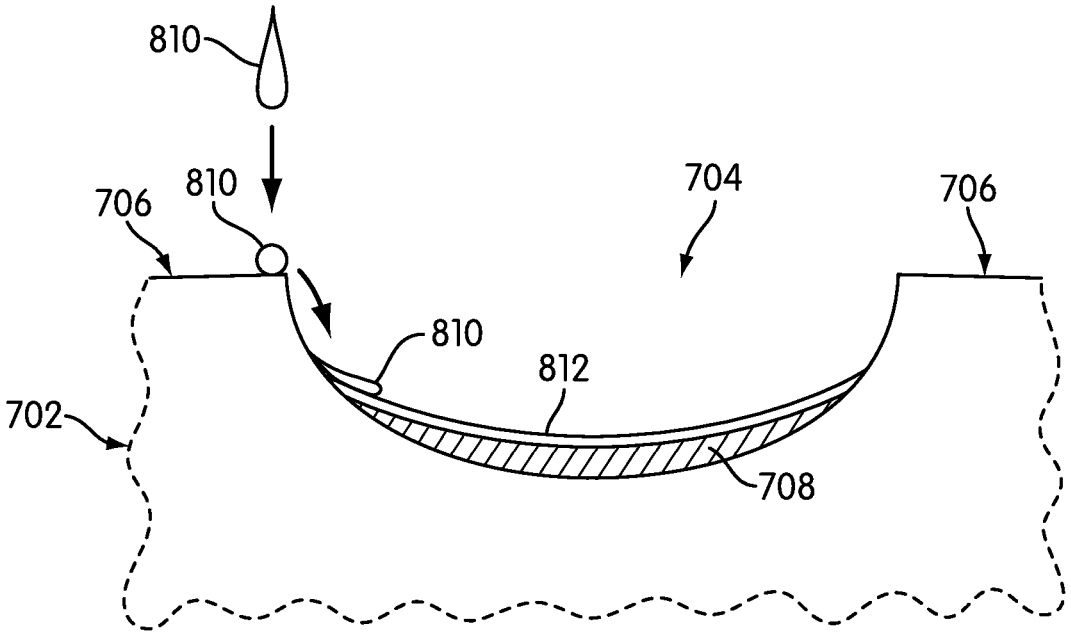
FIG. 8 is a zoomed in view of a water droplet landing on a land area adjacent the dimple of FIG. 7 after the dimple a coating material has been applied.

In addition to the coating materials having various profiles, in some embodiments, the coating material may partially cover the dimple such that the dimple is partially hydrophilic. In some embodiments, portions the dimples may be selectively hydrophilic. FIGS. 7 and 8 illustrate an exemplary embodiment similar to the embodiment of FIGS. 1-3. The difference between the two embodiments is the profile of the coating material and the amount of the dimple covered by the coating material. Like the embodiment of FIGS. 1-3, the embodiment of FIGS. 7 and 8 may include a golf ball having a core 720 and a cover layer 702. Cover layer 702 may include dimples 704. Coating material 708 may be coated on each of dimples 704, forming a thin layer of coating material 708 on a cover layer 702. As shown in FIG. 7, the profile of coating material 708 within each dimple 704 may be such that the only a portion of dimple 704 is coated. For example, coating material 708 may only coat a bottom portion of dimple 704 and may have a maximum thickness at the center of dimple 704. The thickness of coating material 708 may decrease toward the edge of dimple adjacent land area 706. In some embodiments, the portions of the dimple 704 covered by coating material 708 may have a profile different from the profile shown in FIGS. 7 and 8. For example, the profile of coating material 708 may have a uniform thickness. In some embodiments, the portions of dimple 704 covered by coating material 708 and the profile of coating material 708 may be selected based on a variety of factors. For example, the portions of dimple 704 covered by coating material 708 and the profile of coating material 708 may be selected based on the type of material cover layer material used, the type of coating material used, the number of dimples, shape of the dimples, and/or the depth of the dimples. In some embodiments, the portions of the dimple 704 covered by coating material 708 may have a profile different from the profile shown in FIGS. 7 and 8. For example, the profile of coating material 708 may have a uniform thickness.

As shown in FIG. 8, a water droplet 810 may behave in substantially the same way water droplet 310 behaves in FIG. 3. As shown in FIG. 8, water droplet 810 may form a layer 812 as water droplet 810 settles in dimple 704. In some embodiments, the profile of layer 812 may be such that the maximum thickness of layer 812 is in the center of dimple 704 and the thickness decreases toward the edge of dimple 704 adjacent land area 706. As discussed with reference to layer 312, the profile of layer 812 may also vary based on a variety of factors. Similarly, the depth and shape of dimples 704 may be adjusted in the ways described above with reference to FIG. 3 to compensate for the change in depth and shape of dimples 704 caused by water layer 812.

Figure 9:
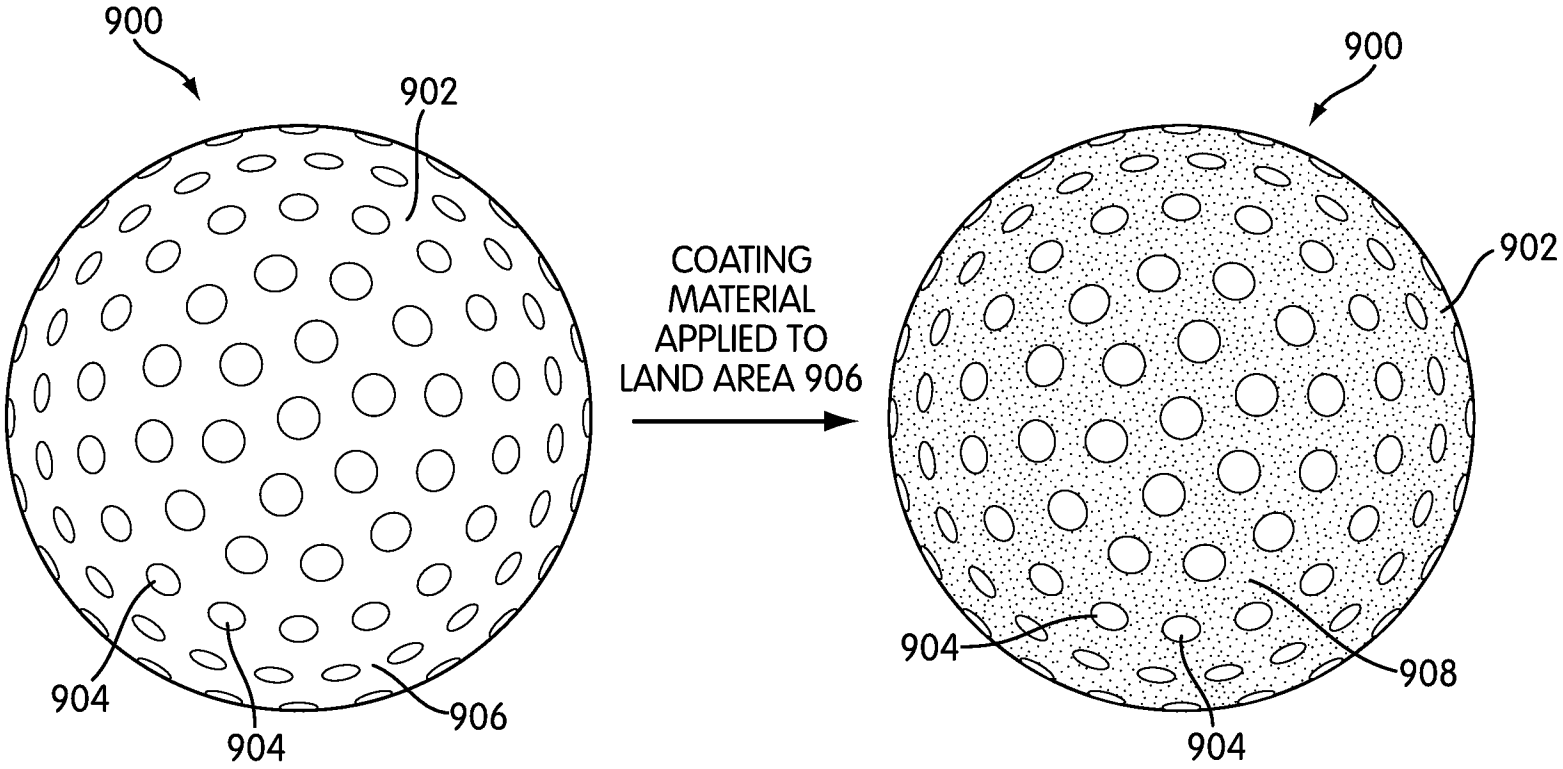
FIG. 9 is an exemplary golf ball before and after a coating material has been applied.

In some embodiments, the land area of a golf ball may be coated with a material having a lower hydrophilicity than the cover layer. For example, FIG. 9 illustrates an embodiment including a golf ball 900 having a cover layer 902 including dimples 904 and a land area 906. A hydrophobic coating material 908 may be applied to land area 906. In such an embodiment, cover layer 902 may include a hydrophilic material. Thus, dimples 904 may be hydrophilic. In some embodiments, portions of dimples 904 may also be coated with coating material 908. Suitable hydrophobic materials and methods of achieving hydrophobic surfaces are discussed above with reference to FIGS. 1-3. The same suitable hydrophobic materials and methods of achieving hydrophobic surfaces may be used to make land area 906 hydrophobic in embodiments in which the land area of a golf ball may be coated with a material having a lower hydrophilicity than the cover layer.

Figure 10:
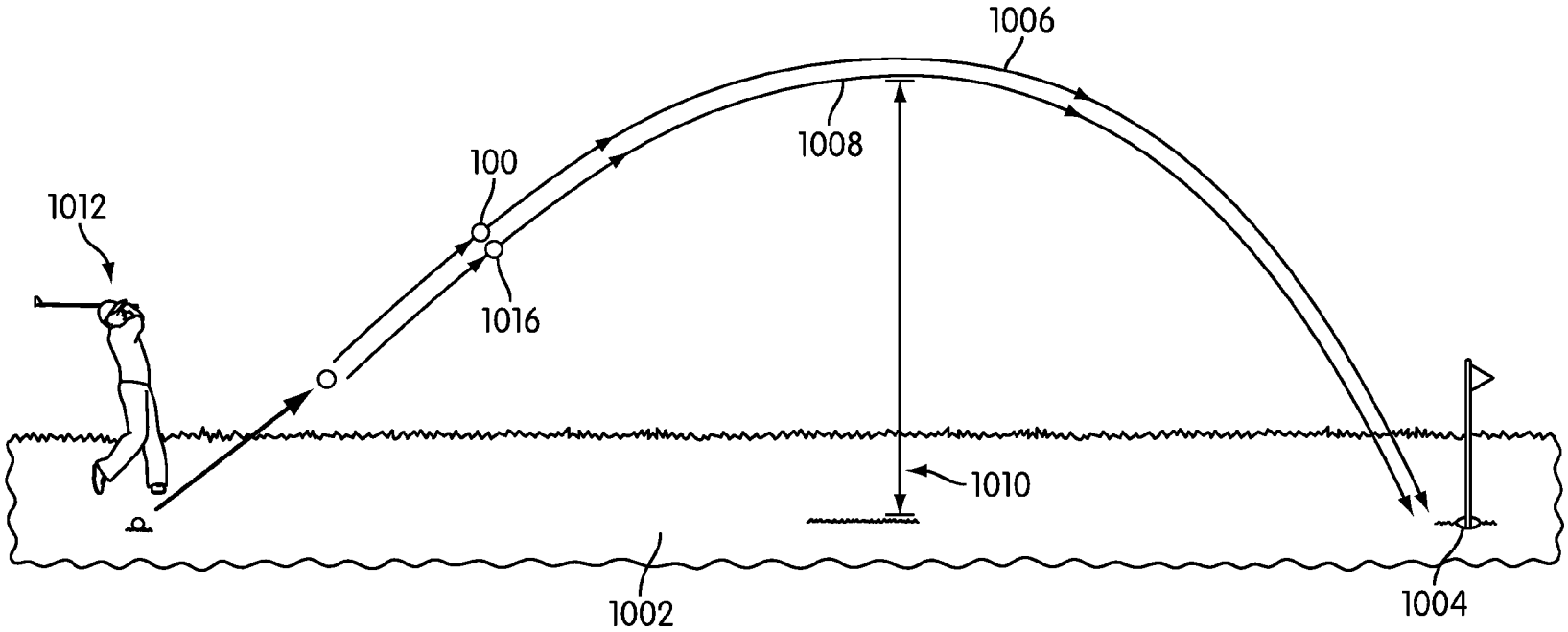
FIG. 10 shows two similar flight paths of two golf balls, after being hit by a golf club swung by a golfer in normal weather conditions.
Figure 11:
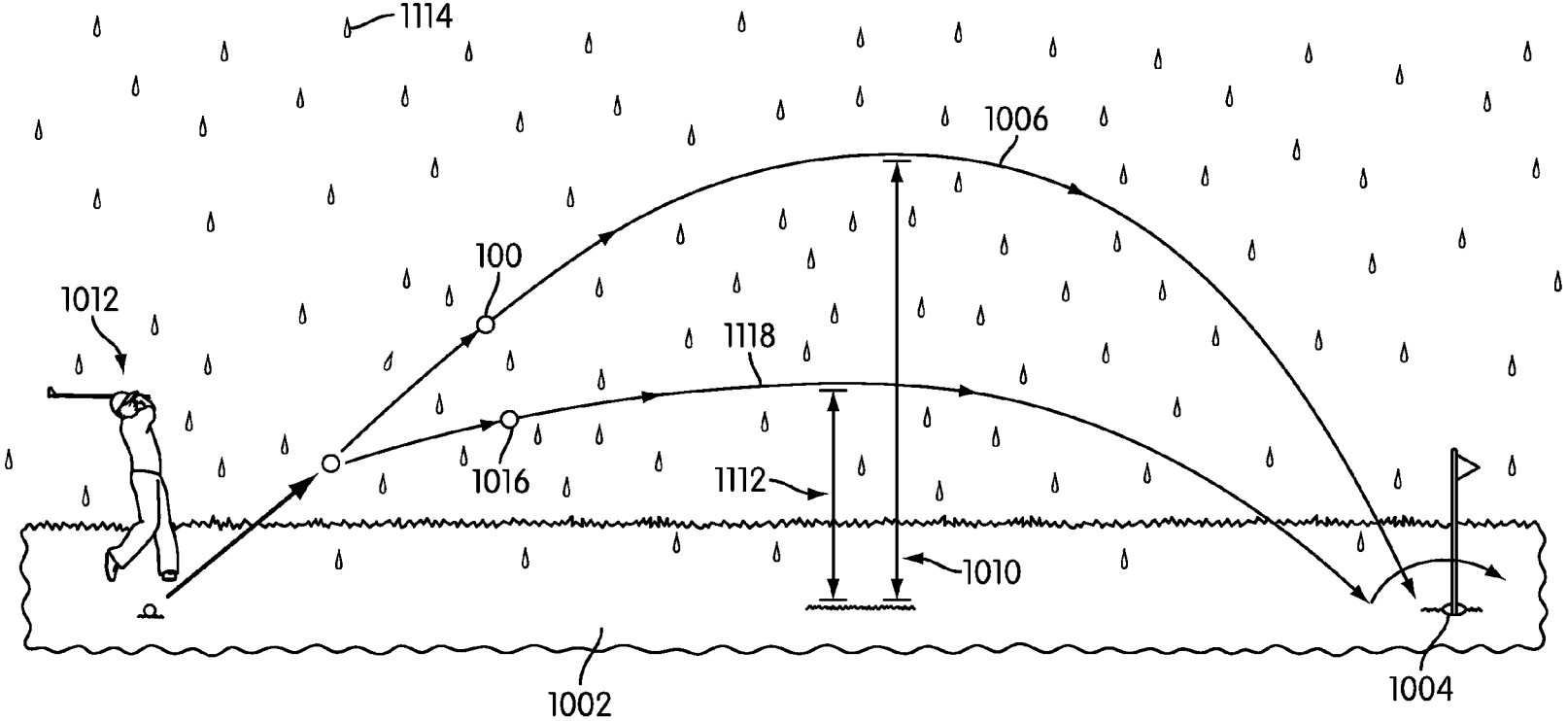
FIG. 11 shows two different flight paths of two golf balls, after being hit by a golf club swung by a golfer in wet weather conditions.

FIGS. 10 and 11 show how golf balls in accordance with the present disclosure may be used to compensate for wet weather conditions. Although not wishing to be bound by any particular usage or effect, the change in dimple depth and surface dryness from the dry state to the wet state may generally allow golf ball 100 to compensate for the effects of wet weather conditions that would otherwise disadvantage conventional golf balls. Specifically, during wet weather, water on a conventional golf ball may decrease the amount of friction between a golf club face and the golf ball during a shot, cause a golf ball to experience a lower trajectory flight path and reduced spin.

FIG. 10 shows a golfer 1012 golfing in fair (i.e., normal, or non-wet) weather conditions. Under these conditions, golf ball 100 (from the embodiment shown in FIG. 1) is in the dry state. Golf ball 100 may follow flight path 1006 toward the tee 1004, achieving a maximum vertical distance of 1010. For comparison, conventional golf ball 1016 is shown following a substantially similar flight path 1008. Conventional golf ball 1016 has the same general aerodynamic properties as golf ball 100 in the dry state.

FIG. 11 shows golfer 1012 golfing in wet weather conditions. Specifically, rain 1014 lands on golf ball 100 and golf ball 1016, as well as the green 1002. As a result of being exposed to water in the form of rain 1114, the land area of golf ball 1016 becomes slick. As a result of the wet weather conditions, conventional golf ball 1016 experiences reduced friction between its cover layer and the golf club face during the shot. Therefore, conventional golf ball 1016 experiences a flight path trajectory 1118 having a lower maximum height 1112. Conventional golf ball 1016 also experiences reduced spin, resulting in poor control of the shot upon landing. In contrast, golf ball 100 compensates for wet playing conditions by repelling moisture from land area 106 and drawing moisture toward coating material 108. The reduced moisture on land area 106 prevents a loss of friction between the club face and land area 106. The reduced moisture also prevents reduced spin, thus preventing poor control of the shot upon landing. Accordingly, the present disclosure provides golf balls better able to compensate for wet weather conditions.

Figure 14:
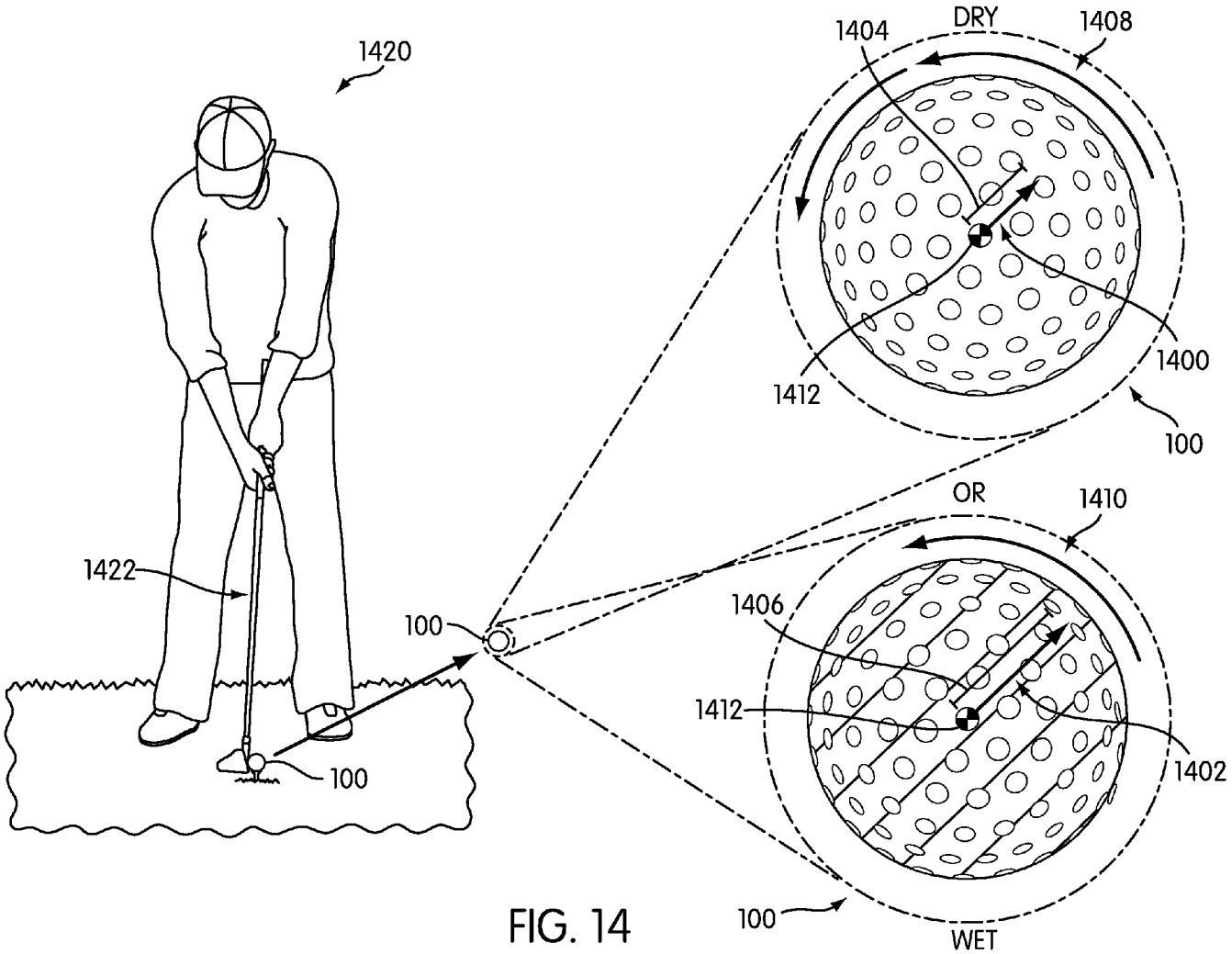

FIG. 14 illustrates a comparison between golf ball 100 when wet and dry. A golfer 1420 may swing a golf club 1422 toward golf ball 100 on a tee. If golf ball 100 is dry, then golf ball 100 may exhibit play characteristics as shown in the upper half of FIG. 14 upon being struck by golf club 1422. Specifically, golf ball 100 may exhibit a high rate of rotation 1408 around its center of gravity 1412 because less moisture may be present on coating material 108 in dry playing conditions. With less moisture present on coating material 108, the moment of inertia of dry ball 100, as graphically illustrated by the length 1404 of the moment arm 1400, may be relatively low. On the other hand, when golf ball 100 is wet, golf ball 100 may exhibit a lower rate of rotation 1410 about its center of gravity 1412 because more moisture may be present on coating material 108. With more moisture present on coating material 108, more weight may be concentrated on the surface of ball 100. As a result, the moment of inertia of wet ball 100, as graphically illustrated by the length 1406 of the moment arm 1402, may be relatively high. This effect on the moment of inertia of ball 100 may be more noticeable in embodiments with thicker coating materials, since more moisture may be attracted to thicker coating materials. Because golf ball 100 may display different play characteristics depending upon whether golf ball 100 is wet or dry, certain golfers may find it more desirable to use golf ball 100 in dry weather or wet weather based on the golfers' preferences.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A golf ball comprising:

a core;

a cover layer surrounding the core, and having a surface including a plurality of dimple area surfaces and a plurality of land area surfaces between the plurality of dimple area surfaces, wherein at least a portion of the dimple area surfaces are more hydrophilic than the land area surfaces as determined by comparing the contact angles between the surfaces and a water droplet.

2. A golf ball comprising:

a core;

a cover layer surrounding the core, the cover layer surface including a plurality of dimple area surfaces and a plurality of land area surfaces between the plurality of dimple area surfaces, wherein at least a portion of the land area surfaces are hydrophobic such that a water droplet has a contact angle of more than 90° and at least a portion of the dimple area hydrophilic such that a water droplet has a contact angle of less than 90°.

3. The golf ball according to claim 2, wherein the at least a portion of the dimple surfaces are made hydrophilic by a hydrophilic coating material.

4. The golf ball according to claim 3, wherein the hydrophilic coating material includes a hydrophilic polymer.

5. The golf ball according to claim 3, wherein the hydrophilic coating material has a uniform thickness.

6. The golf ball according to claim 3, wherein the hydrophilic coating material has a maximum thickness in the middle of the dimple surfaces.

7. The golf ball according to claim 6, wherein the thickness of the hydrophilic coating material tapers toward an edge of the dimple surfaces adjacent the at least one land surface that is hydrophobic.

8. The golf ball according to claim 3, wherein the hydrophilic coating material overlies each dimple surface.

9. The golf ball according to claim 3, wherein a second portion of the dimple surfaces are free of the hydrophilic coating material.

10. The golf ball according to claim 4, wherein the hydrophilic coating material overlies all of the dimple surfaces.

* * * * *